US008127833B2

(12) United States Patent
Pabon et al.

(10) Patent No.: US 8,127,833 B2
(45) Date of Patent: Mar. 6, 2012

(54) METHODS AND APPARATUS FOR HARVESTING POTENTIAL ENERGY DOWNHOLE

(75) Inventors: Jahir Alfonso Pabon, Wellesley, MA (US); James Garland O'Connell, Newtonville, MA (US); Burt S. Tilley, Billerica, MA (US); Matthew E J Brouillard, Hingham, MA (US); Tal Schwartz, Champaign, IL (US); Brandon Christopher Rowan, Hazel Crest, IL (US); Mark Mefika Penner, Clinton, MD (US); Jeremy James Freeman, Vancouver, WA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 392 days.

(21) Appl. No.: 11/610,664

(22) Filed: Dec. 14, 2006

(65) Prior Publication Data

US 2008/0142215 A1 Jun. 19, 2008

(51) Int. Cl.
*E21B 47/00* (2006.01)

(52) U.S. Cl. ..... 166/65.1; 166/254.2

(58) Field of Classification Search ..... 166/254.2, 166/65.1; 310/62, 87

See application file for complete search history.

(56) References Cited

U.S. PATENT DOCUMENTS

| | | | | |
|---|---|---|---|---|
| 2,266,355 | A | 12/1941 | Chun | |
| 5,202,194 | A | 4/1993 | VanBerg, Jr. | |
| 6,675,888 | B2 * | 1/2004 | Schempf et al. | 166/65.1 |
| 6,691,802 | B2 | 2/2004 | Schultz et al. | |
| 7,484,561 | B2 * | 2/2009 | Bridges | 166/248 |
| 2005/0012340 | A1 | 1/2005 | Cousins | |
| 2005/0224223 | A1 * | 10/2005 | Hayes | 166/57 |
| 2005/0241835 | A1 * | 11/2005 | Burris et al. | 166/381 |
| 2006/0016606 | A1 | 1/2006 | Tubel et al. | |

FOREIGN PATENT DOCUMENTS

EP 0747568 B1 12/2000

OTHER PUBLICATIONS

Patent Cooperation Treaty, International Search Report, dated May 14, 2008, 4 pages.

* cited by examiner

*Primary Examiner* — Brad Harcourt

(57) ABSTRACT

Methods and apparatus for harvesting energy while moving a tool through a well are shown and described. The harvested energy can be used by the tool to perform work once it reaches an intended location in the well, or along the way. A considerable amount of potential energy is typically lost by oilfield tools as they move down through a borehole. Methods and apparatus described herein recover and/or store some of the energy during the downward movement of the tool.

13 Claims, 4 Drawing Sheets

METHODS AND APPARATUS FOR HARVESTING POTENTIAL ENERGY DOWNHOLE

FIELD

This relates primarily to the field of oil and gas exploration and production. More particularly, this relates to harvesting energy with a downhole oilfield tool to perform work downhole.

BACKGROUND

An appreciable fraction of oilfield services are provided by lowering tools down a well to perform particular tasks. Possible tasks include formation evaluation (e.g. logging in open hole and cased wells), opening and closing of valves, analyzing downhole fluids, taking fluid samples, removal of scale build-up (e.g. in producing wells). Some of the downhole oilfield tools are conveyed with cables of appropriate mechanical strength. Additionally, the cables may carry electrical power to the tools as well provide a communication link. Cables that carry power and provide downhole communication are generally called "wireline" cables.

However, because of cost constraints associated with wireline operations, many downhole applications use more simple cables that do not have electrical capability. These simple cables are typically called "slick line" cables. In slick line applications, the energy required to power the tool once it is down in the well generally comes from batteries that are included with or added to the tool. Nevertheless, the batteries are expensive, occupy a sizable amount of tool space, and are typically not very environmentally friendly.

SUMMARY

The present disclosure addresses weaknesses of the prior art described above and others. Specifically, one embodiment provides an apparatus comprising a downhole oilfield system. The downhole oilfield system comprises a conveyance and a downhole tool attached to the conveyance. The downhole tool comprises a work performing module (e.g. for logging and/or fluid analysis, etc.) and a potential energy harvesting device. The potential energy harvesting device may be capable of converting potential energy (including pressure fluctuations) into kinetic energy, electrical energy, or stored energy for later use. In one embodiment, the potential energy harvesting device is configured to convert and store potential energy as a result of lowering the downhole tool into a well. In one embodiment, the potential energy harvesting device comprises a turbine/generator pair. In one embodiment, the generator is electrically connected to a battery.

In one embodiment, the potential energy harvesting device comprises a hollow mandrel having an interior portion and at least one side opening in the mandrel leading to the interior portion. In one embodiment, the turbine is arranged in the interior portion. In another embodiment, the potential energy harvesting device comprises at least one external wheel configured to contact and roll along a well wall, and an energy conversion module operatively connected to the at least one external wheel. The energy conversion module may comprise a generator. In one embodiment, an energy storage module is operatively connected to the at least one external wheel. In one embodiment, the energy storage module comprises a flywheel, and the apparatus may further comprise a belt or chain connecting the at least one external wheel to the flywheel. In one embodiment, the energy storage module comprises a generator and a battery.

In one embodiment, the potential energy harvesting device comprises piezoelectric elements electrically connected to an energy storage apparatus, such as a battery. In one embodiment, the potential energy harvesting device comprises a hollow mandrel having an interior portion, at least one opening in the mandrel leading to the interior portion (the interior portion comprising an inside surface geometry configured to cause pressure fluctuations when fluids pass through the interior portion), and the inside surface comprises the piezoelectric elements.

In some embodiments of the apparatus, the conveyance comprises a slick line, wireline, or coiled tubing. In one embodiment, the work performing module comprises a logging module or a fluid analysis module.

One aspect provides a method comprising moving a downhole oilfield tool through a borehole, harvesting energy from the downhole oilfield tool—the harvesting comprising collecting energy from the moving of the downhole tool through a borehole—and storing the energy collected from the moving of the downhole tool through the borehole. One method further comprising performing work downhole with the stored energy. In one aspect, the work comprises one or more of: logging the borehole, opening/closing a valve, analyzing downhole fluids, and removing scale build.

In one aspect of the method, the harvesting comprises flowing fluids through the downhole oilfield tool, rotating a turbine with the flowing fluids, and driving a generator with the turbine. In one aspect, the flowing comprises one or more of: lowering the downhole oilfield tool through the fluids, and oscillating the downhole oilfield tool through the fluids. In one aspect, the harvesting comprises rolling at least one wheel of the downhole oilfield tool along a wall of the borehole, and converting the rolling motion into a usable, stored energy form. In one aspect, the harvesting comprises rolling a plurality of wheels of the downhole oilfield tool along a cased wall of the borehole. In one aspect, the harvesting comprises rolling at least one wheel of the downhole oilfield tool along a wall of the borehole, and rotating a flywheel with the rolling of the at least one wheel. In one embodiment, the harvesting comprises rolling at least one wheel of the downhole oilfield tool along a wall of the borehole, and rotating a generator with the at least one wheel. In one aspect, the harvesting comprises providing an interior channel in the downhole oilfield tool, flowing fluids through the interior channel, causing flow fluctuations through the interior channel with appropriate surface geometry, generating pressure changes from the flow fluctuations, and converting the pressure changes into electrical energy with an active material. The active material may comprise a piezoelectric material. In one aspect, the flowing comprises lowering the downhole oilfield tool through the fluids and/or oscillating the downhole oilfield tool through the fluids.

One embodiment provides an apparatus comprising a downhole slick line tool system. The downhole slick line tool system comprises a slick line, a slick line tool attached to the slick line, the slick line tool comprising a work performing module and an energy harvesting device. The energy harvesting device comprises a mandrel having a channel therethrough, a turbine on a rod disposed in the channel, a generator connected to the rod, and electrical circuitry between the generator and the work performing module. In one embodiment, the work performing module comprises a formation evaluation device.

One aspect provides a method comprising converting potential energy in the form of an oilfield tool mass suspended above a borehole and subject to a gravitational force into one of: stored, reusable kinetic energy or stored electrical energy; and using the stored, reusable kinetic energy or stored electrical energy to perform a task downhole.

BRIEF DESCRIPTION OF THE DRAWINGS

The accompanying drawings illustrate certain embodiments and are a part of the specification.

Figure 1:
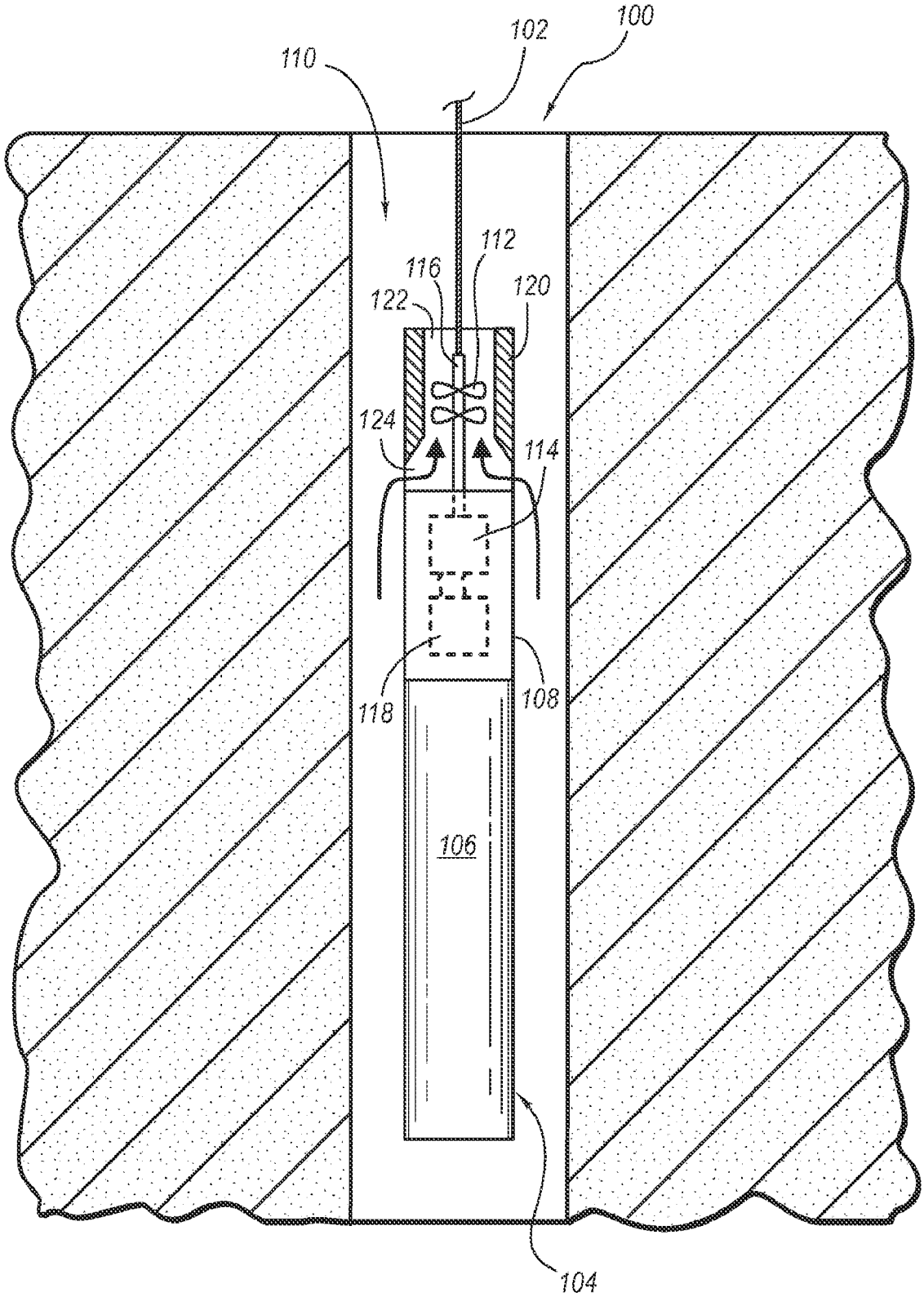
FIG. 1 illustrates a borehole in cross-section and a downhole oilfield system in partial cross-section. The downhole oilfield system includes an energy harvesting device—in the case of FIG. 1 a turbine/generator pair.

Throughout the drawings, identical reference numbers indicate similar, but not necessarily identical elements. While the principles described herein are susceptible to various modifications and alternative forms, specific embodiments have been shown by way of example in the drawings and will be described in detail herein. However, it should be understood that the invention is not intended to be limited to the particular forms disclosed. Rather, the invention includes all modifications, equivalents and alternatives falling within the scope of the appended claims.

DETAILED DESCRIPTION

Illustrative embodiments and aspects of the invention are described below. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present invention. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment of this invention.

Turning now to the drawings, and in particular to FIG. 1, one embodiment of a downhole oilfield system 100 is disclosed. The downhole oilfield system 100 includes a conveyance such as a slick line 102. The conveyance may also comprise coiled tubing, a wireline, or other conveyance. As shown in FIG. 1, a downhole tool 104 is attached to the slick line 102. The downhole tool 104 includes a work performing module 106. The work performing module 106 may include any device for performing work downhole, including, but not limited to a logging device, a fluid analyzer, a descaler, and a mechanical mover (e.g. valve opener).

In some embodiments, the downhole tool 104 also includes a potential energy harvesting device 108. The potential energy harvesting device 108 may be capable of converting potential energy (which includes pressure fluctuations) into kinetic energy, electrical energy, or stored energy for later use. In one embodiment, the potential energy harvesting device 108 is configured to convert and store potential energy as a result of lowering the downhole tool 104 into a well or borehole 110. The potential energy harvesting device 108 may take on any form. In the embodiment of FIG. 1, the potential energy harvesting device 108 comprises a turbine/generator pair. The turbine/generator pair includes at least one turbine 112 (or a plurality of turbines as shown in FIG. 1) coupled to a generator 114. A rod 116 may be common to both the turbine 112 and the generator 114. Further, in one embodiment, the generator 114 is electrically connected to a battery 118. The battery 118 may then store energy to perform work (for example by the work performing module 106). The battery 118 may therefore be electrically connected to any electrically operated machine.

As shown in FIG. 1, the potential energy harvesting device 108 may include a hollow mandrel 120. The hollow mandrel 120 has an interior portion 122 and at least one opening 124 providing for fluid communication between the borehole 110 and the interior portion 122. In the embodiment of FIG. 1, there are a plurality of side openings 124 leading into the interior portion 122, but any other openings may be used. In the embodiment of FIG. 1, the turbine 112 is arranged in the interior portion 122. FIG. 1 illustrates the turbine 112 centrally located in the interior portion 122, but it could also be offset or otherwise arranged.

A mentioned above, there is often a considerable amount of potential energy that is typically lost by conventional downhole tools as they moves from the surface down through a borehole. However, according to principles described herein, methods and apparatus are employed to recover and/or store some of the potential energy associated with movement of the downhole tool 104. The downhole tool 104 of FIG. 1 is equipped with the potential energy harvesting device 108 that harvests energy as the tool is moved through the borehole 110. Movement of the downhole tool 104 may be due to the force of gravity. However, in some aspects, movement is generated by imposing an oscillatory up/down motion from the surface, provided the downhole tool is suspended by a conveyance of appropriate mechanical strength.

According to the embodiment of FIG. 1, harvesting potential energy is accomplished by flowing fluids through the interior portion 122 as the downhole tool 104 traverses the borehole 110. The openings 124 allow downhole fluids to pass through the interior portion 122 as the downhole tool 104, and the flowing fluids rotate the turbine 112. The turbine 112 drives the rod 116, and the rod 116 drives the generator 114. The generator may produce electricity that can be used as it is produced or stored by the battery 118. It will be understood by one or ordinary skill in the art having the benefit of this disclosure that the flowing by the turbine 112 is not necessarily inside the interior portion 112 and can be facilitated simply lowering the downhole tool 104 through the fluids or oscillating the downhole tool 104 through the fluids. The battery 118 may then operate the work performing module 106, and may eliminate the need for separate battery power or wired power from the surface. Accordingly, the apparatus of FIG. 1 may especially useful for slick line applications. The work performing module may consume energy from the generator 114 or the battery 118 to log the borehole 110, cause mechanical movement (for example to open or close a valve), analyze downhole fluids, remove scale build, etc.

Figure 2A:
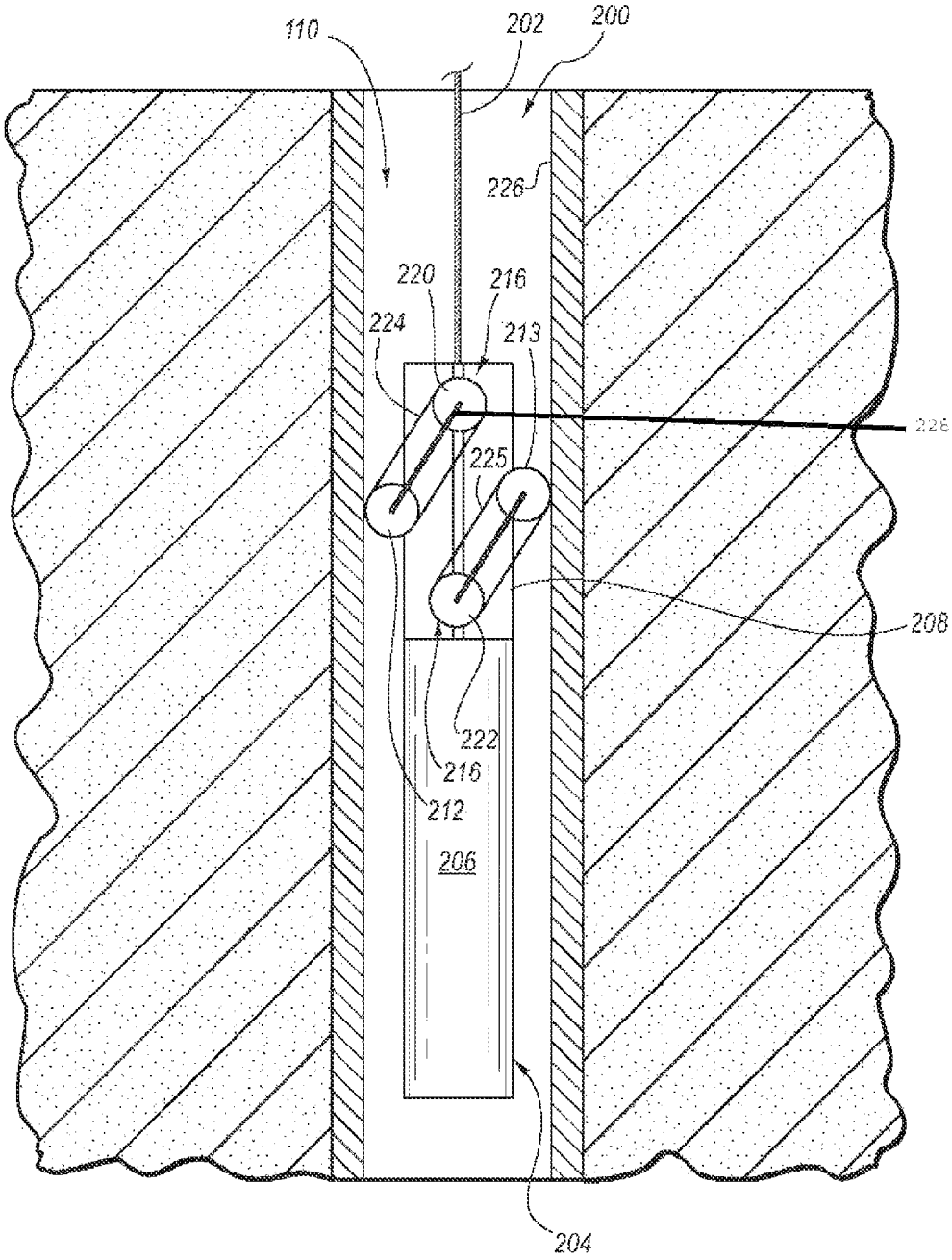
FIG. 2A illustrates the borehole of FIG. 1 in cross-section and another downhole oilfield system in partial cross-section. The downhole oilfield system of FIG. 2A includes a pair of rolling wheels to harvest energy as a downhole tool moves.
Figure 2B:
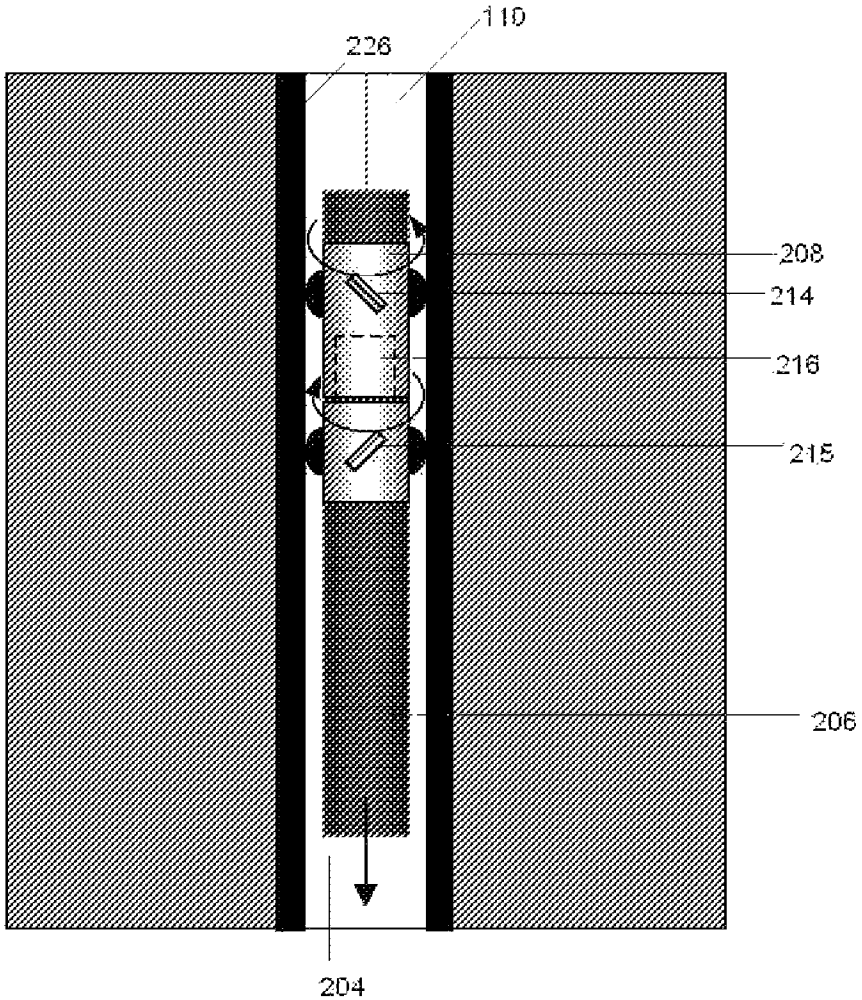
FIG. 2B illustrates the borehole of FIG. 1 in cross-section and another downhole oilfield system in partial cross-section. The downhole oilfield system of FIG. 2B includes a pair of angled rolling wheels to harvest energy as a downhole tool moves

Alternate embodiment are disclosed in FIGS. 2A and 2B. Similar to the embodiment of FIG. 1, the embodiment of FIGS. 2A and 2B provide a downhole oilfield system 200. The downhole oilfield system 200 includes a conveyance such as a slick line 202. A downhole tool 204 is attached to the slick line 202. The downhole tool 204 includes a work performing module 206. The work performing module 206 may include any device for performing work downhole.

The downhole tool 204 also includes a potential energy harvesting device 208. The potential energy harvesting device 208 is capable of converting potential energy into kinetic energy, electrical energy, or stored energy for later use. As with the embodiments described above, the potential energy harvesting device 208 of FIG. 2A is configured to convert and store potential energy as a result of lowering or moving the downhole tool 204 into (or out of) the well or borehole 110. In the embodiment of FIG. 2A, the potential energy harvesting device 208 comprises at least one wheel or other rolling members. For example, as shown in FIG. 2A, the potential energy harvesting device 208 includes two external wheels 212, 213, each wheel attached at the end of an arm 228 and configured to contact and roll along a well wall 226, especially a cased wall. The two external wheels 212, 213 are operatively connected to an energy conversion and/or storage module 216. The energy conversion and/or storage module 216 may comprise a generator. However, in the embodiment of FIG. 2A, the energy conversion and/or storage module comprises first and second flywheels 220, 222. The first external wheel 212 is connected to the first flywheel 220 by a first belt or chain 224, and the second external wheel 213 is connected to the second flywheel 222 by a second belt or chain 225. It will be understood by one of ordinary skill in the art having the benefit of this disclosure that any number of external wheels and flywheels may be used, along with any other connection mechanism there between. The flywheels 220, 222 may store the energy until used mechanically, or they may power a generator or other device.

Accordingly, in some aspects, the harvesting potential energy comprises rolling at least one wheel 212, 213 of the downhole tool 204 along the wall 226 of the borehole 110, and converting the rolling motion into a usable, stored energy form. In one aspect, converting the rolling motion into a usable, stored energy form includes rolling at least one wheel 212, 213 of the downhole tool 204 along the wall 226 of the borehole 110, and rotating the associated flywheel 220, 222 with the rolling of the at least one wheel 212, 213. However, the rolling wheels 212, 213, may also rotate one or more generators. In an alternative embodiment of the present invention, as illustrated in FIG. 2B, the energy harvesting device 208 may include a first rotation inducing set of wheels 214 and a second rotation inducing set of wheels 215. The first and second rotation inducing set of wheels (214,215) may be orientated in opposing directions and designed and orientated to contact the wall 226 of the borehole 110, such that upon moving the work performing module 206 and associated energy harvesting device 208 through a borehole 110 the first and second rotation inducing set of wheels 214, 215 impart a rotation spin to regions of the energy harvesting device 208. The plurality of wheels 214, 215 are designed and oriented to contact the wall 226 of the borehole 110, guaranteeing better all around contact with the wall 226. In the present embodiment, the opposing first and second rotation inducing set of wheels 214, 215 impart opposing rotational energy to the energy harvesting device 208 as it is moved within the borehole. These regions of opposing rotation may be coupled to an appropriate energy conversion and/or storage module 216 such as a generator or flywheel.

Figure 3:
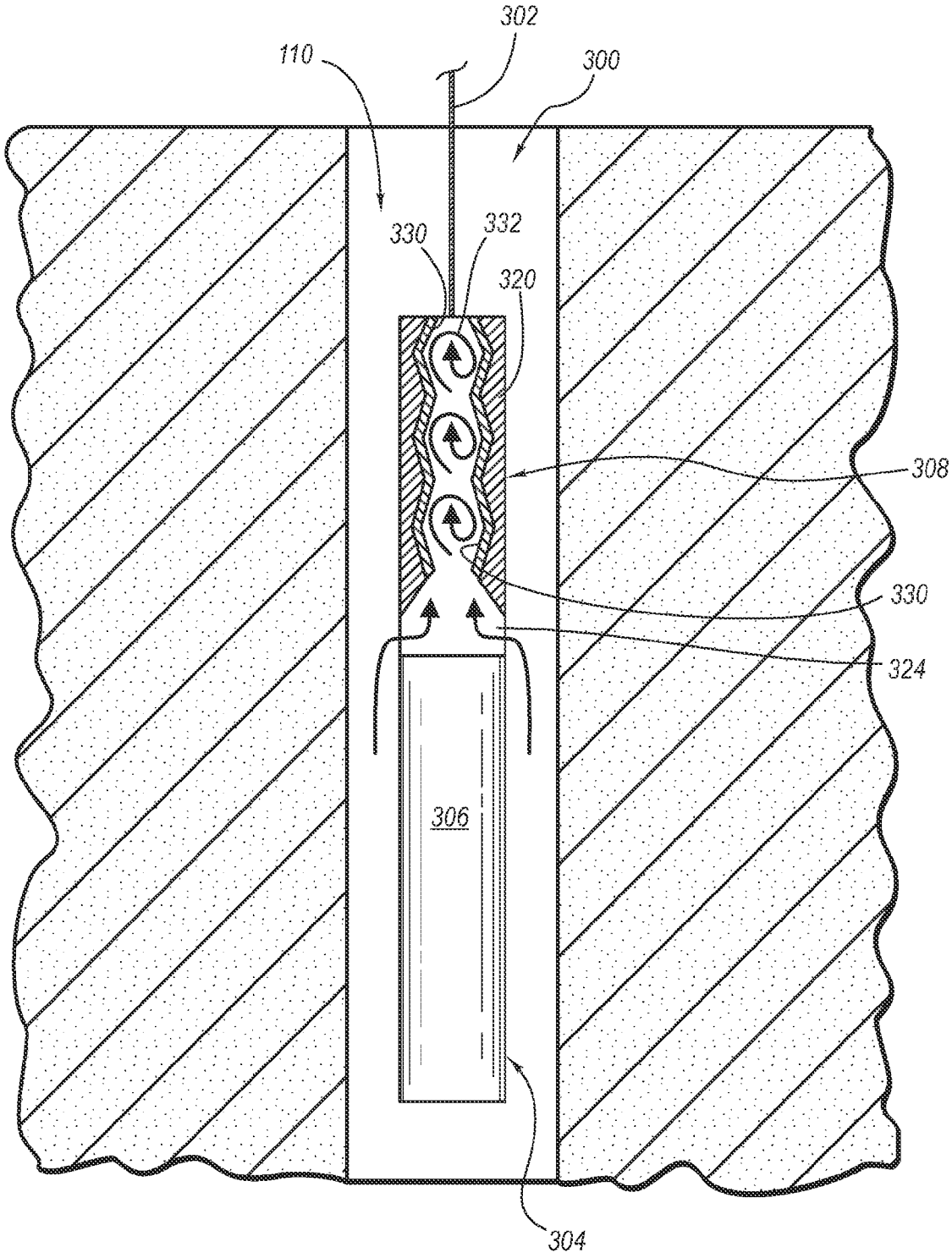
FIG. 3 illustrates the borehole of FIG. 1 in cross-section and another downhole oilfield system in partial cross-section. The downhole oilfield system of FIG. 2A includes an active surface for harvesting energy resulting from changes in pressure.

Another embodiment is disclosed in FIG. 3. Similar to the embodiments of FIGS. 1-2, the embodiment of FIG. 3 provides a downhole oilfield system 300. The downhole oilfield system 300 includes a conveyance such as a slick line 302. A downhole tool 304 is attached to the slick line 302. The downhole tool 304 includes a work performing module 306. The work performing module 306 may include any device for performing work downhole.

The downhole tool 304 also includes a potential energy harvesting device 308. The potential energy harvesting device 308 is capable of converting potential energy in the form of pressure changes into electrical energy for concurrent or later use. As with the embodiments described above, the potential energy harvesting device 308 of FIG. 3 is configured to convert and store potential energy as a result of lowering or moving the downhole tool 304 into (or out of) the well or borehole 110. In the embodiment of FIG. 3, the potential energy harvesting device 308 comprises an active material such as piezoelectric elements 330 electrically connected to an energy storage apparatus, such as a battery 118 (FIG. 1). As shown in FIG. 3, the potential energy harvesting device 308 comprises a hollow mandrel 320 having an interior portion 322, and at least one opening 324 in the mandrel leading to the interior portion 322. The interior portion 322 exhibits an inside surface geometry configured to cause pressure fluctuations when fluids pass therethrough, and the inside surface comprises the piezoelectric elements 330. For example, the inside surface geometry of the interior portion 322 may alternate between increases and decreases in diameter as shown. Changes in internal diameter with a flow therethrough results in pressure fluctuations. The piezoelectric elements convert pressure fluctuations into electrical currents, which can be used immediately to perform work to charge a battery.

Accordingly, in one aspect, the lowering (or raising/oscillating) the downhole oilfield tool 304 through fluids in the borehole 110 causes pressure fluctuations in the interior portion 322. Pressure fluctuations may be converted by the piezoelectric elements 330 into electrical currents that charge batteries and/or power work from the work producing module 306.

The preceding description has been presented only to illustrate and describe certain embodiments. It is not intended to be exhaustive or to limit the invention to any precise form disclosed. Many modifications and variations are possible in light of the above teaching.

The embodiments and aspects were chosen and described in order to best explain the principles of the invention and its practical application. The preceding description is intended to enable others skilled in the art to best utilize the principles in various embodiments and aspects and with various modifications as are suited to the particular use contemplated.

What is claimed is:

1. An apparatus, comprising:

a downhole oilfield system, the downhole oilfield system comprising:

a conveyance;

a downhole tool attached to the conveyance, the downhole tool comprising;

a work performing module;

a potential energy harvesting device configured to convert and store potential energy as a result of lowering or raising the downhole tool in a well; and wherein the potential energy harvesting device comprises a first plurality of rotation inducing angled wheels and a second plurality of rotation inducing angled wheels oriented in opposing directions configured to contact and roll along a well wall;

the first and second plurality of rotation inducing angled wheels imparting an opposing rotation spin to regions of the energy harvesting device; and an energy storage module operatively connected to the regions of opposing rotation and harvesting energy from the relative rotation between the regions of opposing rotation.

2. An apparatus according to claim 1, wherein the potential energy harvesting device comprises:

an energy conversion module operatively connected to the regions of opposing rotation.

3. An apparatus according to claim 1, wherein the potential energy harvesting device comprises:

a generator operatively connected to the regions of opposing rotation.

4. An apparatus according to claim 1, wherein the energy storage module comprises a plurality of flywheels.

5. An apparatus according to claim 1, wherein the energy storage module comprises a generator and a battery.

6. An apparatus according to claim 1, wherein the conveyance comprises one of:

slick line, wireline, and coiled tubing.

7. An apparatus according to claim 1, wherein the work performing module comprises one or more of a logging module and a fluid analysis module.

8. A method, comprising:

moving a downhole oilfield tool through a borehole;

harvesting energy from the downhole oilfield tool, the harvesting comprising collecting energy from the moving of the downhole tool through a borehole;

storing the energy in an energy storage module collected from the moving of the downhole tool through the borehole;

rolling a first plurality of rotation inducing angled wheels and a second plurality of rotation inducing angled wheels oriented in opposing directions along a wall of the borehole;

the first and second plurality of rotation inducing angled wheels imparting an opposing rotation spin to regions of the energy harvesting device; and converting the rolling motion into a usable, stored energy form wherein the energy storage module is operatively connected to the regions of opposing rotation and harvesting energy from the relative rotation between the regions of opposing rotation.

9. A method according to claim 8, further comprising performing work downhole with the stored energy.

10. A method according to claim 9, wherein the work comprises one or more of: logging the borehole, opening/closing a valve, analyzing downhole fluids, and removing scale build.

11. A method according to claim 8, wherein the wall of the borehole is a cased wall.

12. A method according to claim 8, wherein the harvesting comprises:

rotating a plurality of flywheels with the rolling of the first and second plurality of rotation inducing angled wheels.

13. A method according to claim 8, wherein the harvesting comprises:

rotating a generator with the rolling of the first and second plurality of rotation inducing angled wheels.

* * * * *